US006669136B2

(12) United States Patent
Niioka et al.

(10) Patent No.: US 6,669,136 B2
(45) Date of Patent: Dec. 30, 2003

(54) PAPER MONEY HANDLING DEVICE

(75) Inventors: Yasunari Niioka, Seto (JP); Takeshi Kanagawa, Owariasahi (JP); Hiroki Matsuse, Owariasahi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/012,038

(22) Filed: Dec. 11, 2001

(65) Prior Publication Data

US 2002/0113160 A1 Aug. 22, 2002

(30) Foreign Application Priority Data

Dec. 22, 2000 (JP) ..... 2000-390757

(51) Int. Cl.[7] ..... B65H 23/198
(52) U.S. Cl. ..... 242/528; 271/3.01; 271/216
(58) Field of Search ..... 242/528; 271/3.01, 271/216

(56) References Cited

U.S. PATENT DOCUMENTS 2,981,492 A * 4/1961 Simjian ..... 242/528
3,191,882 A * 6/1965 Riedel ..... 242/528
3,743,200 A * 7/1973 Hommerin ..... 242/528

FOREIGN PATENT DOCUMENTS

JP 10-181972 7/1998

* cited by examiner

*Primary Examiner*—Kathy Matecki
*Assistant Examiner*—Sang Kim
(74) *Attorney, Agent, or Firm*—McDermott, Will & Emery

(57) ABSTRACT

In a paper money handling device of the type in which paper money conveying unit, wheel driving unit and reel driving unit are driven to wind a tape between a wheel and a reel and to rewind the tape wound on the wheel to the reel and to deliver paper money, an initial diameter of the reel and a moving speed of the tape are calculated on the basis of the add-up value of pulses generated from an encoder, and the wheel driving unit and the reel driving unit are controlled so that the moving speed so calculated attains a set speed. Jamming is prevented by slightly changing the set speed from the speed of the paper money conveying unit.

13 Claims, 11 Drawing Sheets

PAPER MONEY HANDLING DEVICE

BACKGROUND OF THE INVENTION

This invention relates to a paper money handling device for receiving and delivering paper money. More particularly, this invention relates to a control technology of a tape conveying speed in a paper money receipt/delivery device (e.g. a temporary depository) for receiving and delivering paper money by winding and rewinding a tape between a wheel and a reel.

Some paper money handling devices for receiving and delivering paper money are equipped with a paper money receipt/delivery device that receives paper money by winding a tape and paper money on a wheel and delivers paper money by rewinding the tape onto the reel, on the contrary. The paper money receipt/delivery device having such a construction has the merit that a compact and economical device can be achieved with a simple construction.

JP-A-10-181972, for example, discloses a paper money receipt/delivery device for executing a receipt/delivery processing of paper money, that has a construction in which two tapes are wound onto separate reels, a wheel winds the tape together with paper money while paper money is interposed between the two tapes, and the tape is wound and rewound between the reel for winding only the tape and the wheel to execute the paper money receipt/delivery processing.

Among the prior art examples described above, there is also known a paper money receipt/delivery device that is equipped with means for controlling driving means for the reel and the wheel to control the tape speed when paper money is received and delivered. However, such a paper money receipt/delivery device involves the following problems.

The conventional devices include a system that calculates an outer diameter of the wheel for winding the tape with paper money and calculates a winding speed from the wheel outer diameter, a system that calculates the present outer diameter of the wheel on the basis of the number of times of winding of the tape, a tape thickness and a paper money thickness, and calculates a tape moving speed on the outer periphery of the wheel from the wheel outer diameter so calculated and from a pulse interval time acquired by pulse interval counting means for measuring an interval time of pulses generated by rotating pulse generation means that generates the pulses in such a fashion as to correspond to the rotating speed of the wheel, a system that calculates the diameter of the wheel by using a formula for determining the diameter of a corresponding circle, to the tape outer periphery, from the total sectional area of the sum of a winding sectional area of the tape as viewed from the number of paper money wound up and the sectional area of a winding drum, and a system that determines the number of times of winding of the tape onto the wheel by using a calculation formula expressed by a recurrence formula calculated by a paper note length and a gap distance between paper money received from an initial diameter of tape winding.

In this case, variance develops in the outer diameter of the wheel due to the difference of the thickness and size resulting from the difference of kind of paper money or due to the difference of paper money storing gap. It is therefore difficult in practice to estimate the outer circumferential diameter of the wheel from the number of paper money received, and variance develops also in the tape moving speed that is set on the basis of the outer circumferential diameter of the wheel. To improve the processing speed, it would be conceivable to increase the conveying speed of paper money, to reduce the mutual transfer gap of paper money or to use the direction of the minor side of paper money as the conveying direction, but such methods result in variance of the wheel outer diameter. Nonetheless, mechanical detection of the outer circumferential diameter of the wheel invites the increase of the cost.

SUMMARY OF THE INVENTION

It is an object of the present invention to provide an economical paper money handling device which can accurately acquire a conveying speed of a conveying path and a receiving/delivering speed of a tape when paper money is received one by one and is delivered one by one, and in which jamming difficultly occurs.

To accomplish the object described above, a paper money handling device according to one aspect of the present invention includes paper money conveying means for conveying paper money, a wheel connected to one of the ends of a tape, for winding paper money with the tape, a reel connected to the other end of the tape, for rewinding the tape wound on the wheel, wheel driving means for driving the wheel, and reel driving means for driving the reel, the wheel driving means and the reel driving means winding and rewinding the tape between the wheel and the reel when they are driven to thereby wind paper money conveyed from the paper money conveying means with the tape onto the wheel, or rewinding the tape wound with paper money on the wheel to the reel and delivering paper money to the paper money conveying means. When a predetermined amount of the tape is wound on the wheel, an initial diameter of the reel is calculated on the basis of an add-up value of pulses generated from an encoder in such a fashion as to correspond to a rotating angle of the wheel and an add-up value of pulses generated by an encoder in such a fashion as to correspond to a rotating angle of the reel, a moving speed of the tape is calculated by use of this initial diameter, and the wheel driving means and the reel driving means are controlled so that the moving speed calculated by moving speed calculation means attains a predetermined set value.

Additionally, jamming can be prevented by setting the set speed to a speed higher than the conveying speed of the paper money conveying means when the wheel rotates in the tape winding direction, and setting it to a lower speed than the paper money conveying means when the wheel rotates in the tape delivering direction.

DESCRIPTION OF THE EMBODIMENTS

A paper money receipt/delivery device according to an embodiment of the present invention will be explained prior to the explanation of a tape speed controller of the present invention.

Figure 13:
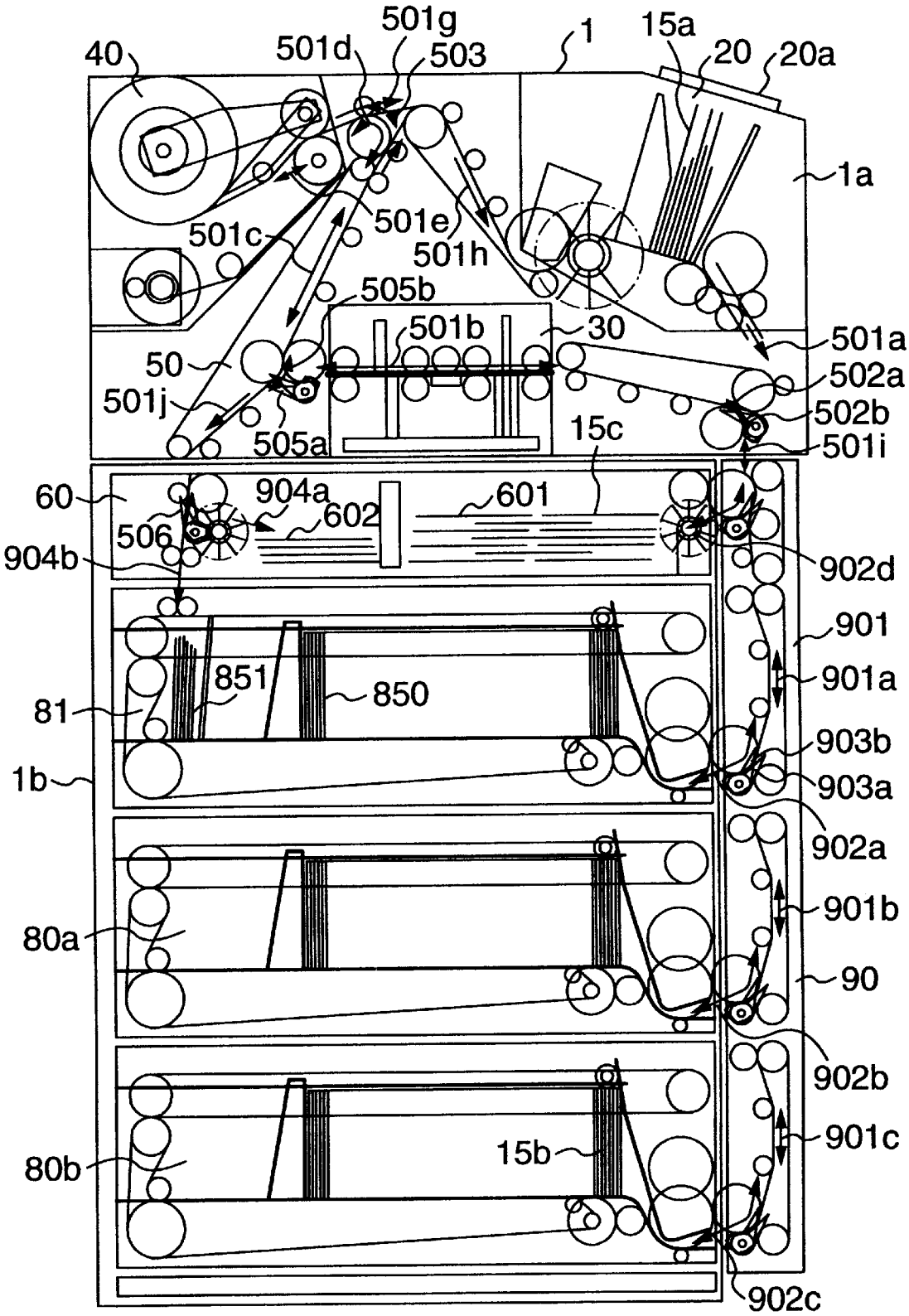
FIG. 13 is a schematic view of a paper money handling device having the paper money receipt/delivery device of the present invention mounted thereto.

FIG. 13 is a sectional view of a portion to which the paper money receipt/delivery device (temporary depository) 40 is to be applied. The flow of paper money at the time of a receipt operation will be hereby explained.

When paper money is put into a receipt/delivery port 20 handling paper money of various kinds and sizes in mixture, paper money is separated one by one at the receipt/delivery port 20 and is then delivered to a conveying path 501. Paper money 15*a* thus delivered passes through the conveying path 501, is classified by a classifying device 30 in accordance with the kind and is then stored temporarily in a paper money receipt/delivery device 40 while various kinds of paper money remain in mixture.

A notifying device, not shown, notifies a user of the amount of paper money 15*a* collectively charged into the receipt/delivery port 20 on the basis of the classification result of the classifying device 30. After the amount is confirmed and the transaction is thus completed, various kinds of paper money in mixture inside the paper money receipt/delivery device 40 are delivered through the conveying path 501, and are stored in the depositories 80*a*, 80*b* and 60 in accordance with the kinds of paper money on the basis of the classification result of the classifying device 30.

Next, the delivery operation will be explained.

The paper money handling device 1 separates various kinds of paper money in the designated amount from the depositories 80*a* and 80*b* corresponding to the kinds of paper money. Paper money 15*b* so separated passes through the conveying path 501 from a conveying path 901 and is subjected to classification of the kind by the classifying device 30. After the result proves as normal, normal paper money 15*b* is transferred to the receipt/delivery port 20 and is delivered. Paper money 15*b* that is not judged by the classifying device 30 as being suitable for delivery depending on the conveying condition and the note condition is temporarily stored in the paper money receipt/delivery device 40. After the paying transaction is completed, paper money inside the paper money receipt/delivery device 40 is delivered and is stored in the depository 601 from the conveying path 501*c* through conveying paths 501*i* and 902*d*.

As explained above, the paper money receipt/delivery device 40 according to the present invention is applied to a paper money receipt/delivery device 40 of the type that is used for temporarily storing paper money before this paper money is stored in the depositories 60, 80*a* and 80*b*.

Next, an embodiment of the paper money receipt/delivery device according to the present invention will be explained.

Figure 1:
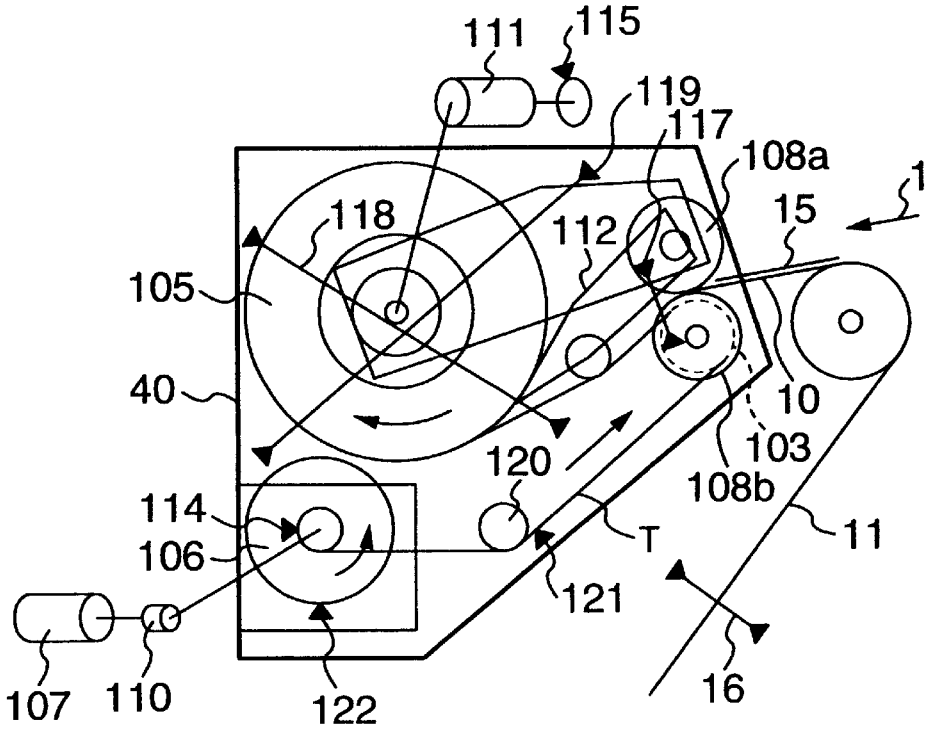
FIG. 1 is a side view useful for explaining a paper money receipt/delivery operation of a paper money receipt/delivery device according to the present invention.
Figure 2:
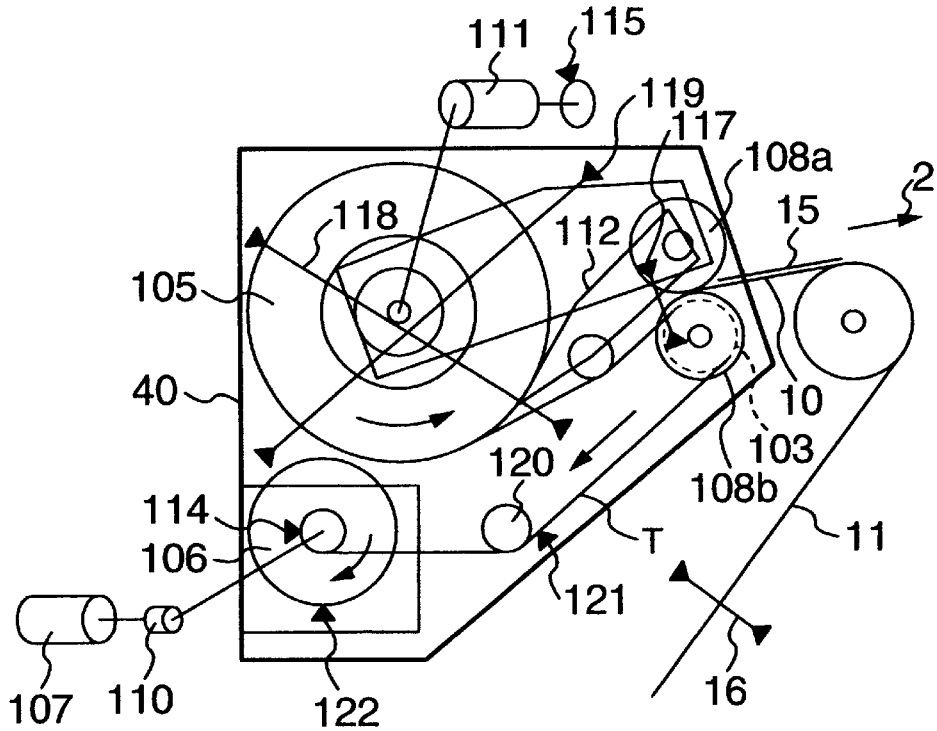
FIG. 2 is a side view useful for explaining a paper money delivery operation of the paper money receipt/delivery device according to the present invention.
Figure 3:
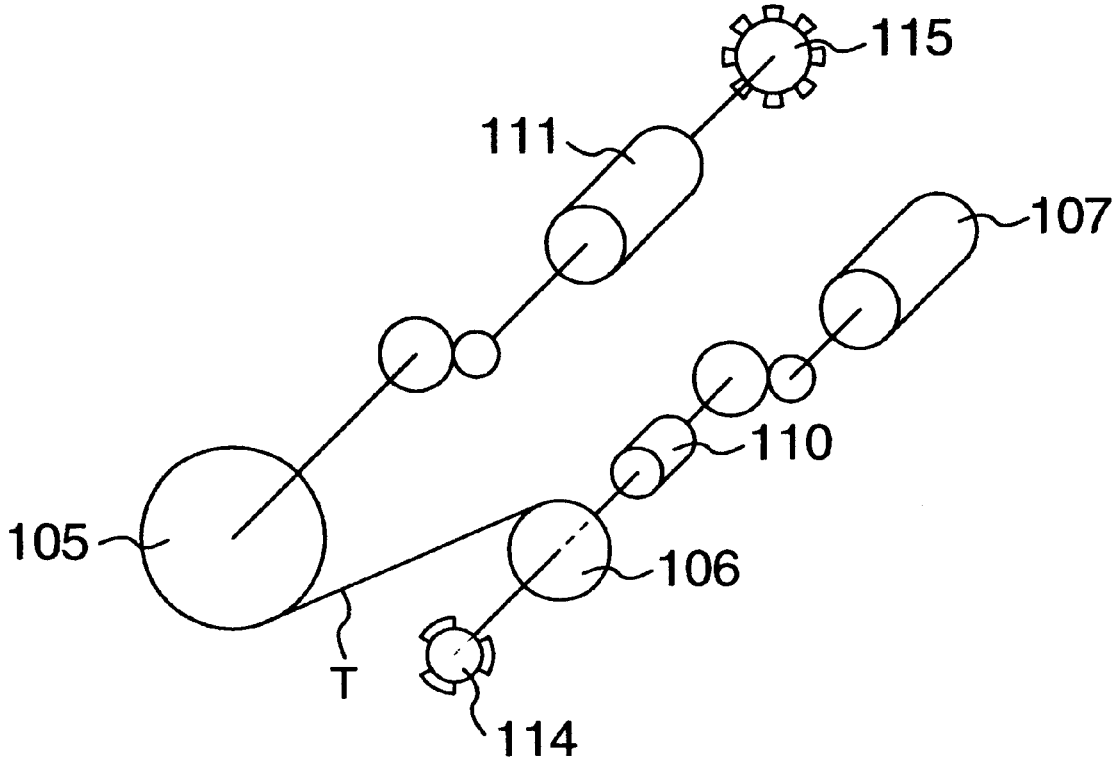
FIG. 3 is a conceptual view of the paper money receipt/delivery device according to the present invention.

FIGS. 1 and 2 show the paper money receipt/delivery device in the present invention. This paper money receipt/delivery device is constituted as a temporary depository 40 and is built in the paper money handling device 1. Paper money 15 is received and delivered with the minor side of paper money as the conveying direction.

In the paper money receipt/delivery device, the rotating direction of each of the later-appearing rollers and drums and the traveling direction of a tape are reversed depending on the receipt and delivery operations of paper money, but in the following explanation, the direction of arrow 1 will represent the paper money receiving direction and the direction of arrow 2, the paper money delivering direction.

This paper money receipt/delivery device uses one sheet of tape T, and includes a reel 106 for winding only the tape T (without paper money). When paper money 15 is received, the tape T delivered from the reel 106 and paper money 15 conveyed through a conveying path 11 and through a space between rollers 108*a* and 108*b* are guided to a wheel 105 for winding them up while they are in superposition. When paper money 15 is delivered, the tape T is delivered from the wheel 105 while it is superposed with paper money 15. A guide 112 provided to a paper money receipt/delivery portion separates the tape T from paper money 15, and an idler roller (driven roller) 103 guides the tape T so separated to the reel 106.

The reel 106 is provided with a reel driving motor 107 driven for rotation through a torque limiter 110 for limiting tension. The reel 106 can detect the number of revolution by means of an encoder 114 (that generates pulses $P_1$ times per revolution). Unlike a rotating speed, the term "number of revolution" hereby corresponds to a rotating angle, and the number of revolution can be determined as a number of revolution per unit time, whenever necessary.

The wheel 105 is fitted to the back of the idler roller 103, and winds paper money 15 while it is superposed on the tape T when paper money is received. A wheel driving motor 111 is provided to the wheel 105 to drive the wheel 105 for rotation at a speed reduction ratio $G_w$. An encoder 115 (that generates pulses $P_2$ time per revolution) is fitted to the wheel driving motor 111 and can detect the number of revolution.

A sensor 117 is interposed between the rollers 108*a*, 108*b* and the wheel 105. Various sensors are provided to the temporary depository 40 besides the sensor 117. Remaining paper money sensors 118 and 119 are provided so as to detect paper money remaining on the wheel 105. When even one paper money remains as wound on the wheel 105, either one of these remaining paper money sensors 118 and 119 can detect such remaining paper money.

A tape tip sensor 121 is interposed between the idler roller 103 and a tape guide roller 120, and a tape end sensor 122 is fitted to the outer peripheral portion of the reel 106 to detect the end position of the tape T wound on the reel 106.

The conveying path 10 for receiving or delivering paper money 15 is provided at the front part of the paper money receipt/delivery port of the temporary depository 40. The relation between the conveying speed of this conveying path 10 and the speed of each portion inside the temporary depository 40 will be later explained in detail in the paragraph of the function and effect.

Next, the operation of the tape system paper money receipt/delivery device having the construction described above will be explained.

To receive paper money 15 into the temporary depository 40, the wheel 105 is rotated clockwise (in the arrow direction) as shown in FIG. 1. In this instance, the rotating speed of the wheel 105 is set in such a fashion that the winding speed V1 of the tape T is higher by about 3% than the conveying speed V2. As paper money 15 is pulled into the temporary depository 40, jamming of paper money can be prevented.

At this time, the reel 106 rotates at the tape winding speed V1 in the tape discharging direction (counter-clockwise), but the reel driving motor 107 rotates counter-clockwise the reel 106 at a speed V3 lower by about 5 to 8% than the tape winding speed V1.

As a result, when the wheel 105 winds the tape T, the reel 106 rotates in such a fashion that the tape winding speed reaches the speed V1 in the counter-clockwise direction due to the traction of the tape. Because the reel driving motor 107 causes the reel 106 to rotate at the tape speed V3 lower by 5 to 8% than the tape winding speed V1, however, a tension develops in the tape T. When this tension exceeds a predetermined value, the torque above the predetermined value acts on the torque limiter 110 and the reel 106 rotates counter-clockwise at the tape winding speed V1. As a result, the tension corresponding to the set torque of the torque limiter 110 is always applied to the tape T.

Receipt of paper money 15 is conducted in this manner and the receiving operation is completed. The number of paper money 15 received in this case is detected on the basis of the count result of the receipt/delivery sensor 117. Whenever a receipt instruction of paper money 15 is given, the operation described above is repeated and paper money 15 is wound on the wheel 105 and is received. As the receipt of paper money 15 proceeds and the tape end sensor 122 detects the end of the tape T, the receipt of paper money is stopped.

Next, to deliver paper money 15 from the temporary depository 40, the wheel 105 is rotated counter-clockwise (in the direction of arrow) as shown in FIG. 2.

At this time, the reel 106 is rotated at the tape winding speed $V_1$ in the tape winding direction (clockwise), but the reel driving motor 107 causes the reel 106 to rotate clockwise at the speed $V_3$ higher by about 5% than the tape delivering speed $V_1$.

As a result, when the tape T is delivered from the wheel 105, the reel driving motor 107 rotates clockwise the reel 106 at the tape winding speed $V_3$ but the wheel 105 is so arranged as to rotate at the tape speed $V_1$ lower by about 5% than the rotation speed $V_3$ of the reel driving motor 107. In consequence, the tension develops in the tape T. When this tension exceeds a predetermined value, the torque higher than the predetermined value acts on the torque limiter 110, so that the reel 106 is rotated clockwise at the tape delivering speed $V_1$. After all, the tension corresponding to the set torque of the torque limiter 110 is always imparted to the tape T.

As the tape T is rewound from the wheel 105 in this way, paper money 15 between the wheel 105 and the tape T is delivered from the paper money receipt/delivery port to the conveying path 10 through the space between the rollers 108*a* and 108*b*. After all paper money is delivered, the tape T is delivered from the wheel 105 until the tape tip sensor 121 detects the initial position of the tape T. When the tape initial position is detected, the wheel driving motor 111 and the reel driving motor 107 stop operating, and after the remaining paper money sensors 118 and 119 confirm that no paper money remains in the temporary depository 40, the operation is completed.

During this paper money delivering operation, the relation between the speed $V_1$ of the tape T and the conveying speed $V_2$ of the conveying path 10 is so set as to satisfy the relation $V_1<V_2$. Because the speed $V_2$ is set to be by about 3% higher than the speed $V_1$, paper money 15 can be pulled out.

Figure 5:
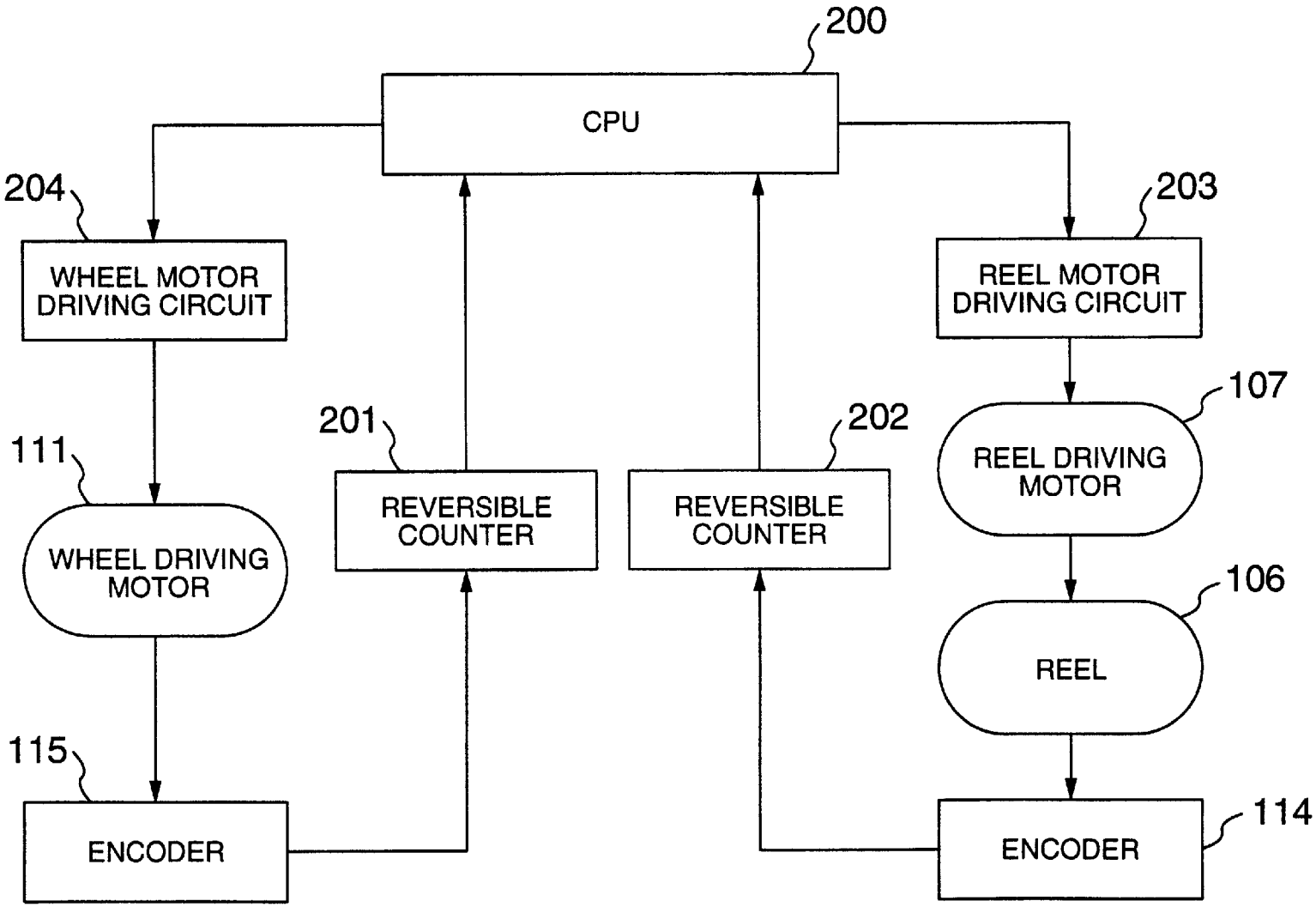
FIG. 5 is a structural view of a control circuit for controlling a tape speed.

A CPU 200 shown in FIG. 5 executes controls of the paper money receipt/delivery processing and the operations of the reel driving motor 107 and the wheel driving motor 111 associated with the former. Reversible counters 201 and 202 respectively count the pulses acquired from the encoder 114 in accordance with the revolution of the reel 106 and the pulses acquired from the encoder 115 in accordance with the revolution of the wheel driving motor 111, and acquire the count values corresponding to the position of the tape T.

For, the tape T has open ends, or in other words, a winding start position (tip) and a winding finish position (end) as viewed from the wheel 105, and the tape must be operated while its absolute position is kept grasped.

In this embodiment, the count value is set to zero (0) with the sensing position of the tape tip sensor 121 as the reference. The count outputs of the reversible counters 201 and 202 are inputted to the CPU 200. The CPU 200 executes the data processing and determines the tape traveling position and the moving distance or the moving speed, and uses these data for the paper money receipt/delivery processing and for controlling the reel driving motor 107 and the wheel driving motor 111 associated with this processing. The reel driving motor 107 and the wheel driving motor 111 are driven and controlled by the outputs of the CPU 200 through the reel motor driving circuit 203 and the wheel motor driving circuit 204, respectively.

A series of control contents executed by the CPU 200 in the present invention will be explained with the flowchart.

(1) Explanation of Flow of Paper Money Receipt Processing:

The reel driving motor 107 and the wheel driving motor 111 are driven through the motor drive circuits 203 and 204, respectively, in accordance with ON/OFF (normal/reverse) instruction from the CPU 200. The encoder 114 (that generates $P_1$ times pulses per revolution) can detect the number of revolution of the reel 106 and the encoder 115 (that generates $P_2$ times pulses per revolution) can detect the number of revolution of the wheel driving motor 111. The speed can be controlled by use of the numbers of revolutions so detected.

Next, the receipt processing will be explained.

Figure 6:
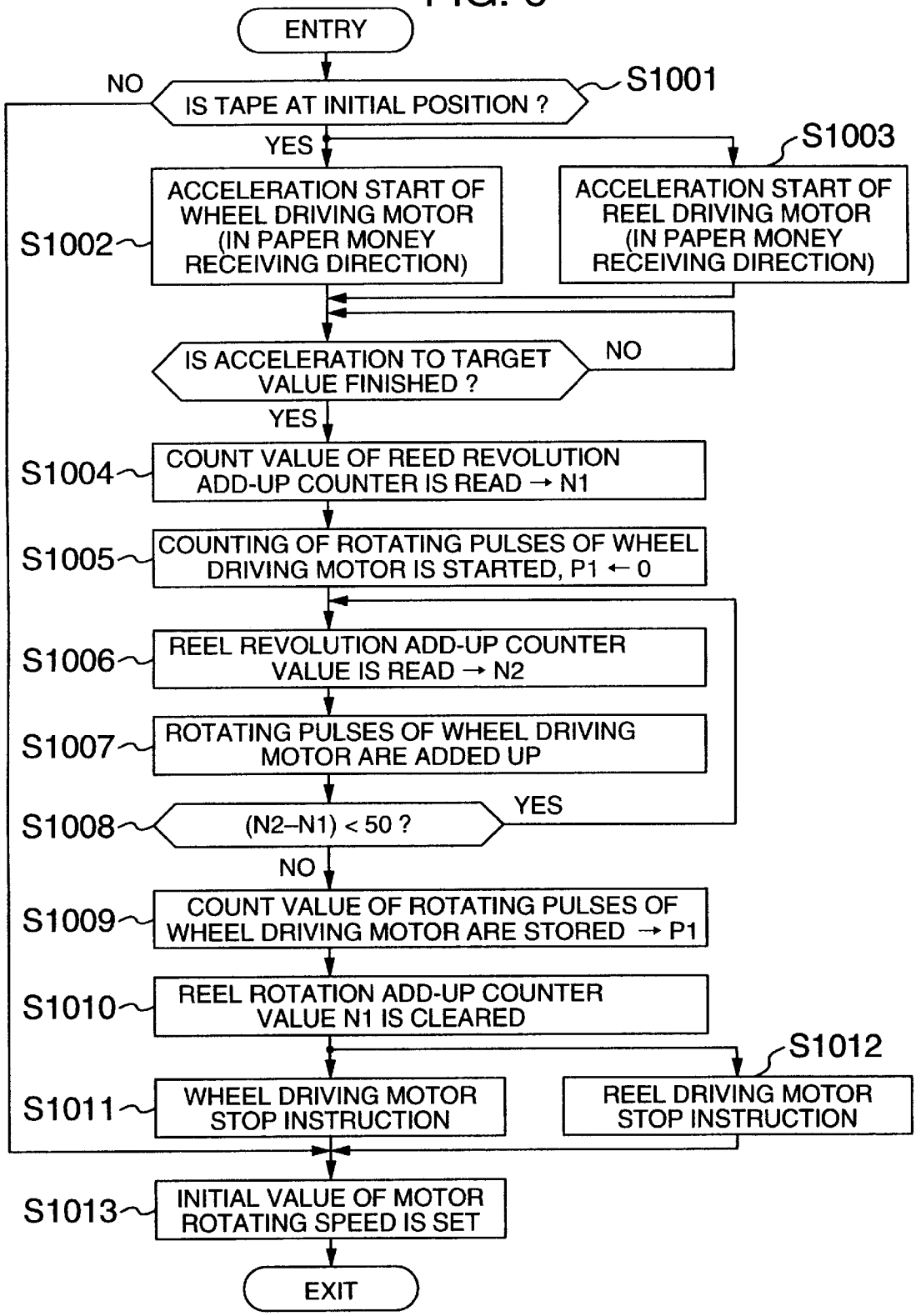
FIG. 6 is a flowchart useful for explaining a paper money receipt preparation operation.
Figure 7:
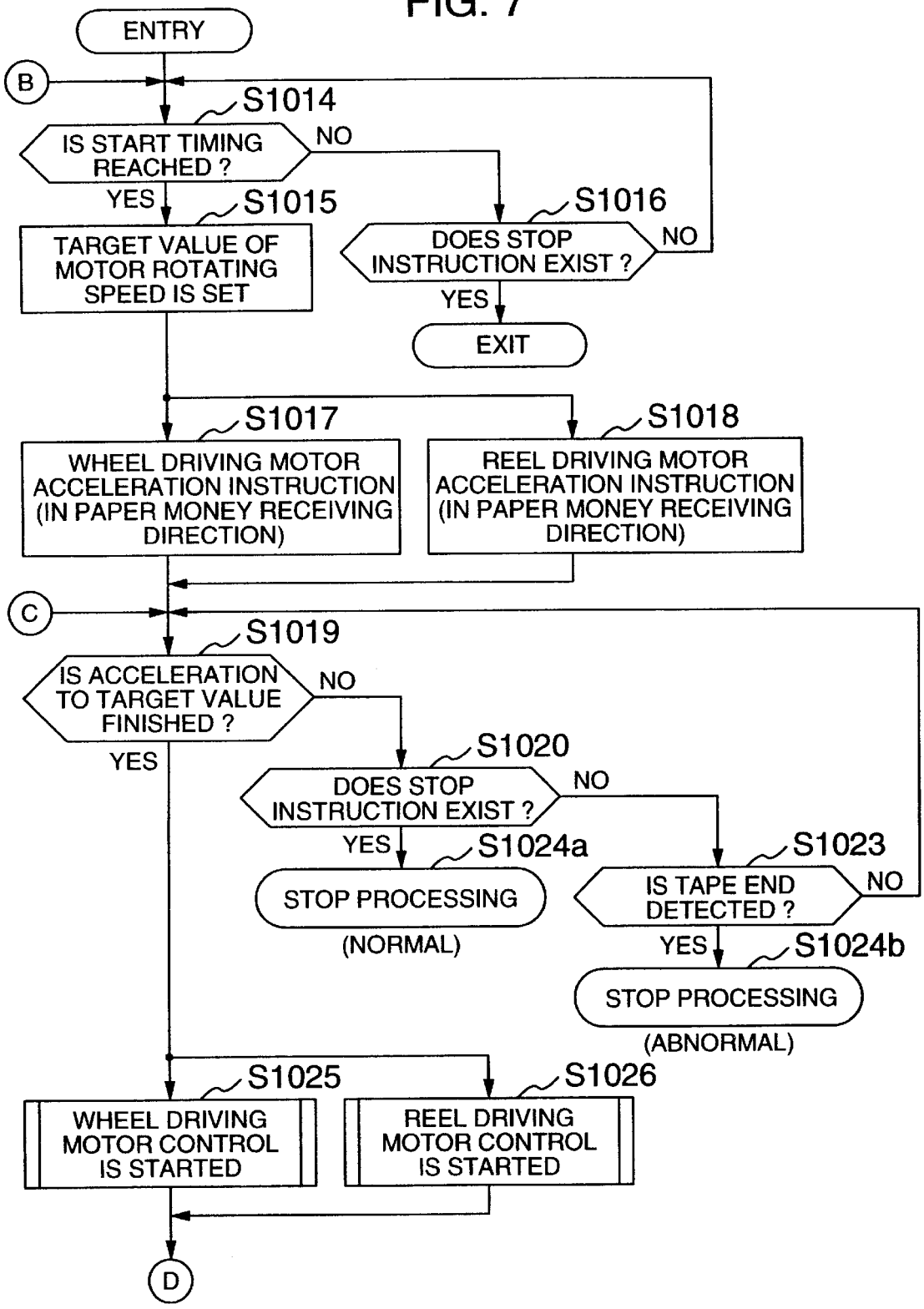
FIG. 7 is a flowchart useful for explaining a paper money receipt operation (No. 1)
Figure 8:
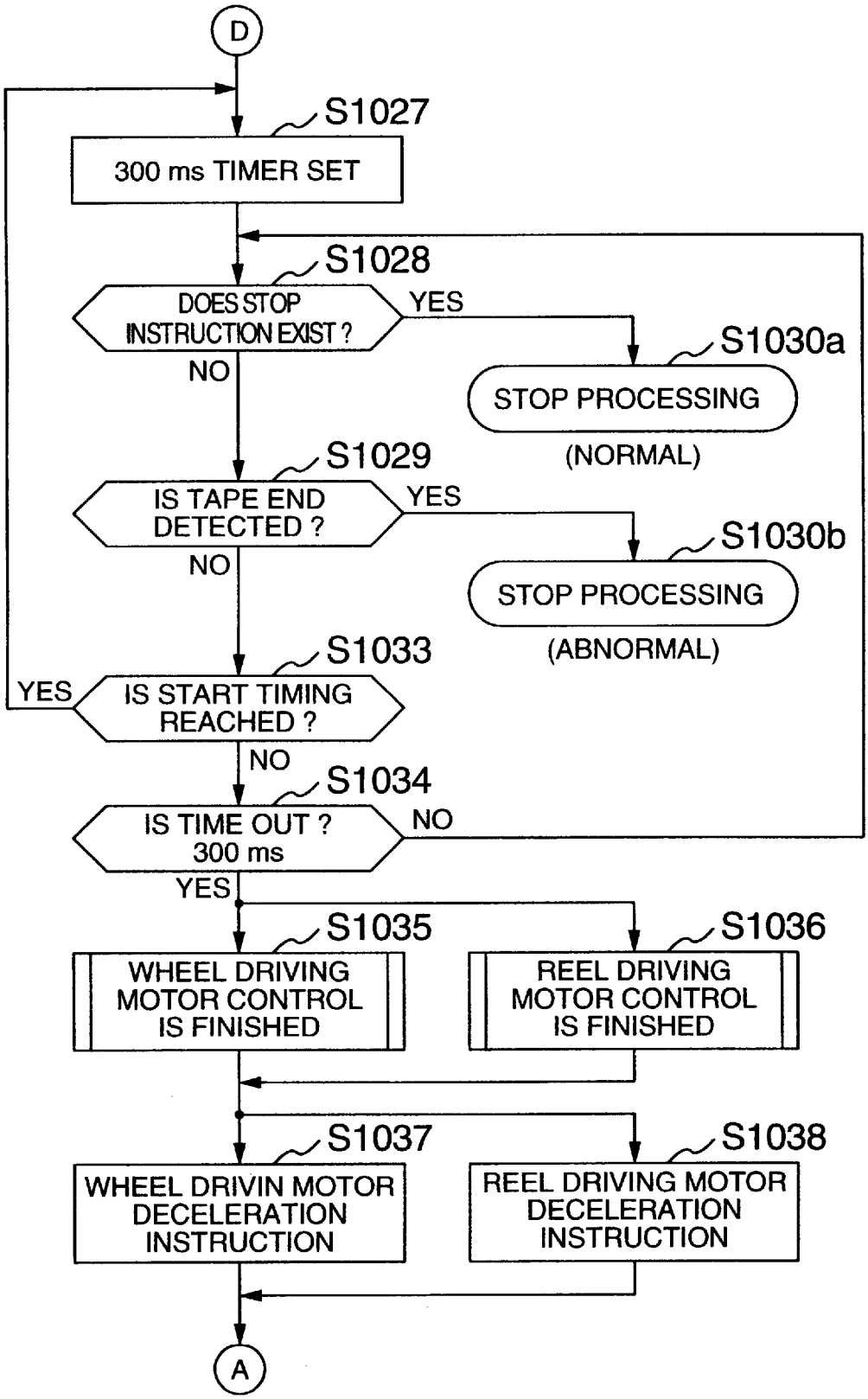
FIG. 8 is a flowchart useful for explaining a paper money receipt operation (No. 2)
Figure 9:
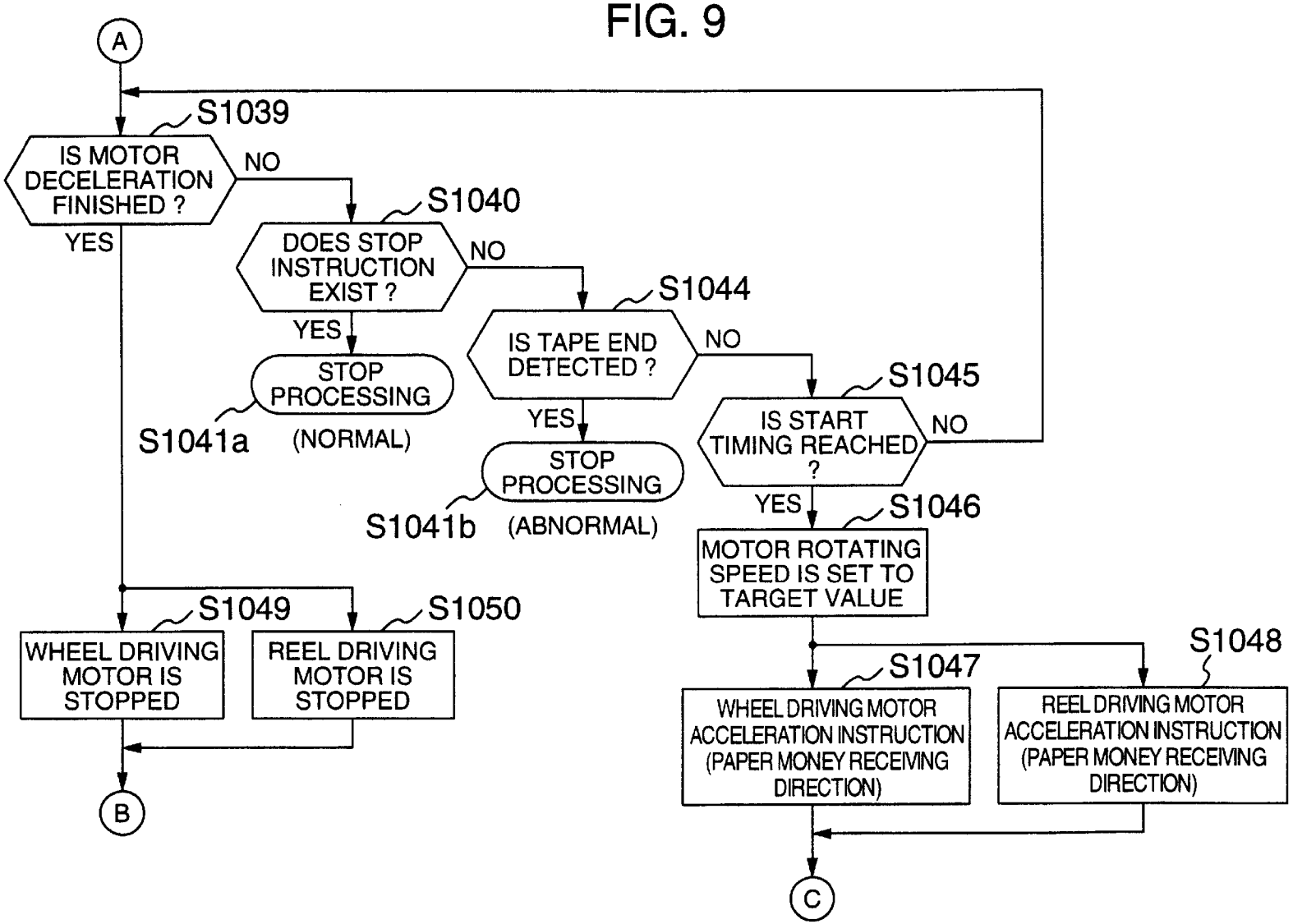
FIG. 9 is a flowchart useful for explaining a paper money receipt operation (No. 3)

FIG. 6 is a flowchart of the paper money receipt preparation operation, and FIGS. 7 to 9 are flowcharts of the paper money receipt operation.

(a) Explanation of Flow of Paper Money Receipt Preparation Operation:

In the paper money receipt preparation operation shown in FIG. 6, whether or not the tape T exists at the initial position is confirmed (Step S1001). When the tape T exists at the initial position (Step S1001: Yes), the wheel driving motor 111 and the reel driving motor 107 are accelerated to a speed $V_{WM}$ (revolution/sec) and a speed $V_{RM}$ (revolution/sec), respectively, in the paper money receiving direction (Steps S1002 and S1003).

After the accelerations to the target speeds are finished, the add-up value of the rotational pulses from the start of acceleration of the reel 106 is set to $N_1$ (Step S1004) and at the same time, the add-up value $P_1$ of the rotational pulses of the wheel driving motor 111 is set to zero (0) (Step S1005). The add-up value of the rotational pulses of the reel 106 is read and is set to $N_2$ (Step S1006), and the rotational pulse of the wheel driving motor 111 at this time is added up (Step S1007).

Here, if $(N_2-N_1)$ does not reach 50 (Step S1008: No), Steps S1006 and S1007 are repeated until the difference reaches 50. When ($N_2$–$N_1$) reaches 50 (Step S1008: Yes), the add-up value $P_1$ of the rotational pulses of the wheel driving motor 111 at that time is stored (Step S1009), and the rotation add-up value $N_1$ of the reel 106 is reset to zero (0) (Step S1010). Both wheel driving motor 111 and reel driving motor 107 are stopped (S1011 and S1012). The initial values of the rotating speeds of the wheel driving motor 111 and the reel driving motor 107 are set (Step S1013), and the receipt preparation operation is finished.

(b) Explanation of Flow of Receipt Operation:

When the paper money receipt operation is started, the sensor 16 first detects the existence/absence of paper money 15 on the conveying path as shown by the flowchart of FIGS. 7 to 9 (Step S1014). If paper money 15 does not exist (Step S1014: No), the flow enters standby until the existence of paper money is confirmed unless the receipt operation is finished (Step S1016).

When the existence of paper money is confirmed (Step S1014: Yes), the wheel driving motor 111 and the reel driving motor 107 are accelerated in the paper money receiving direction (Steps S1017 and S1018), and the flow enters standby until the target speed set in Step S1013 is reached. When the speed reaches the target value (Step S1019: Yes), speed control of the wheel driving motor 111 and the reel driving motor 107 is executed (Steps S1025 and S1026). Speed control of the wheel driving motor 111 and the reel driving motor 107 is continued until the motors stop, and the detail of this control will be described later.

Next, the sensor 16 on the conveying path 16 waits for a predetermined time such as 300 (ms) as the paper money absence time (Step S1033). When the sensor 16 continuously detects the absence of paper money for 300 (ms) (Step S1034: Yes), control of the wheel driving motor 111 and the reel driving motor 107 is finished (Steps S1035 and S1036), and the wheel driving motor 111 and the reel driving motor 107 are decelerated (Steps S1037 and S1038) and are then stopped (Steps S1049 and S1050). After the motors are stopped, the flow again returns to Step S1014.

The processing described above is repeated until the stop instruction of the receipt processing is given (Steps S1016: Yes, S1020: Yes, S1028: Yes, S1040: Yes), or until the tape end sensor 122 detects the tape end (Steps S1023: Yes, S1029: Yes, S1044: Yes).

Figure 10:
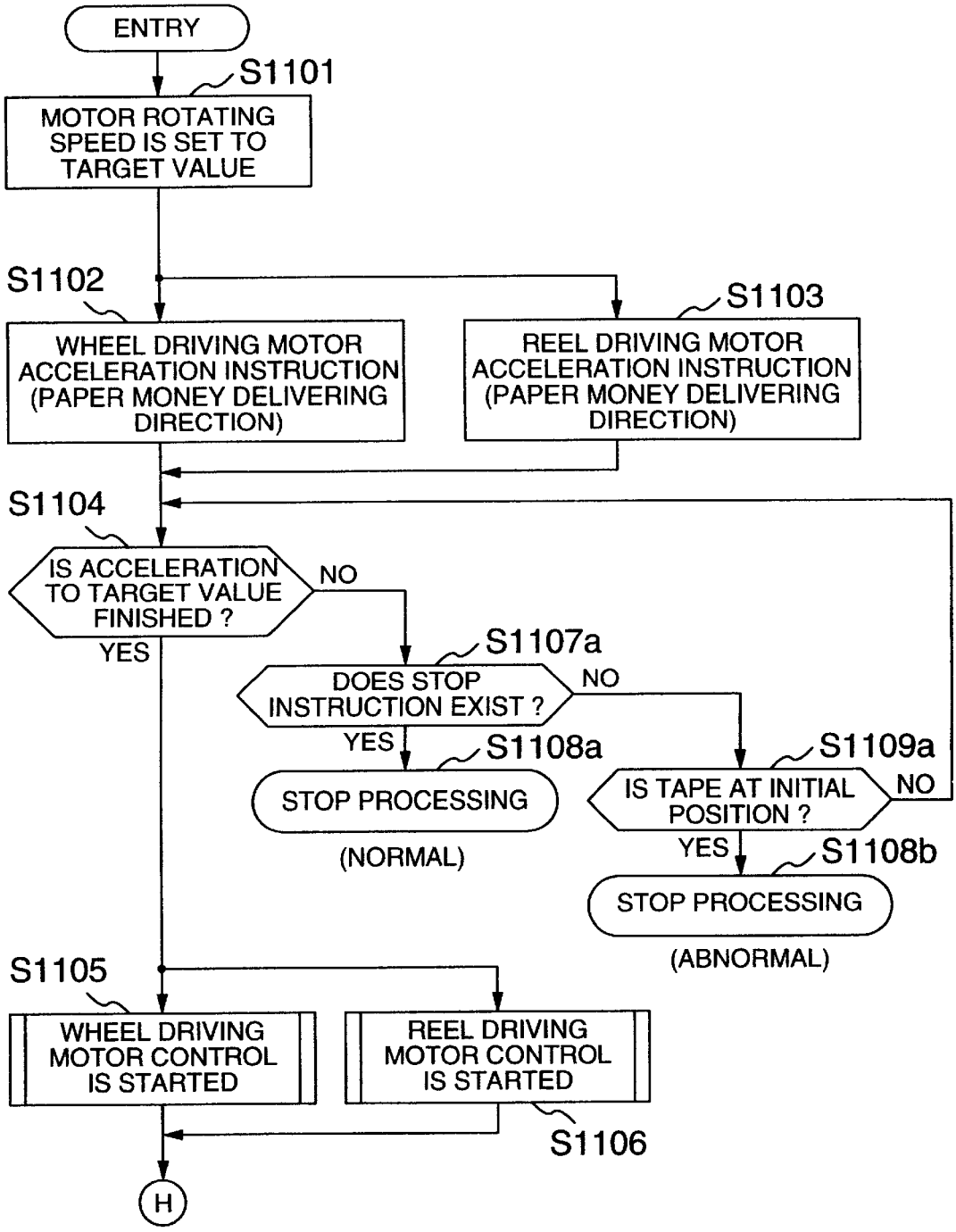
FIG. 10 is a flowchart useful for explaining a paper money delivery processing (No. 1)
Figure 11:
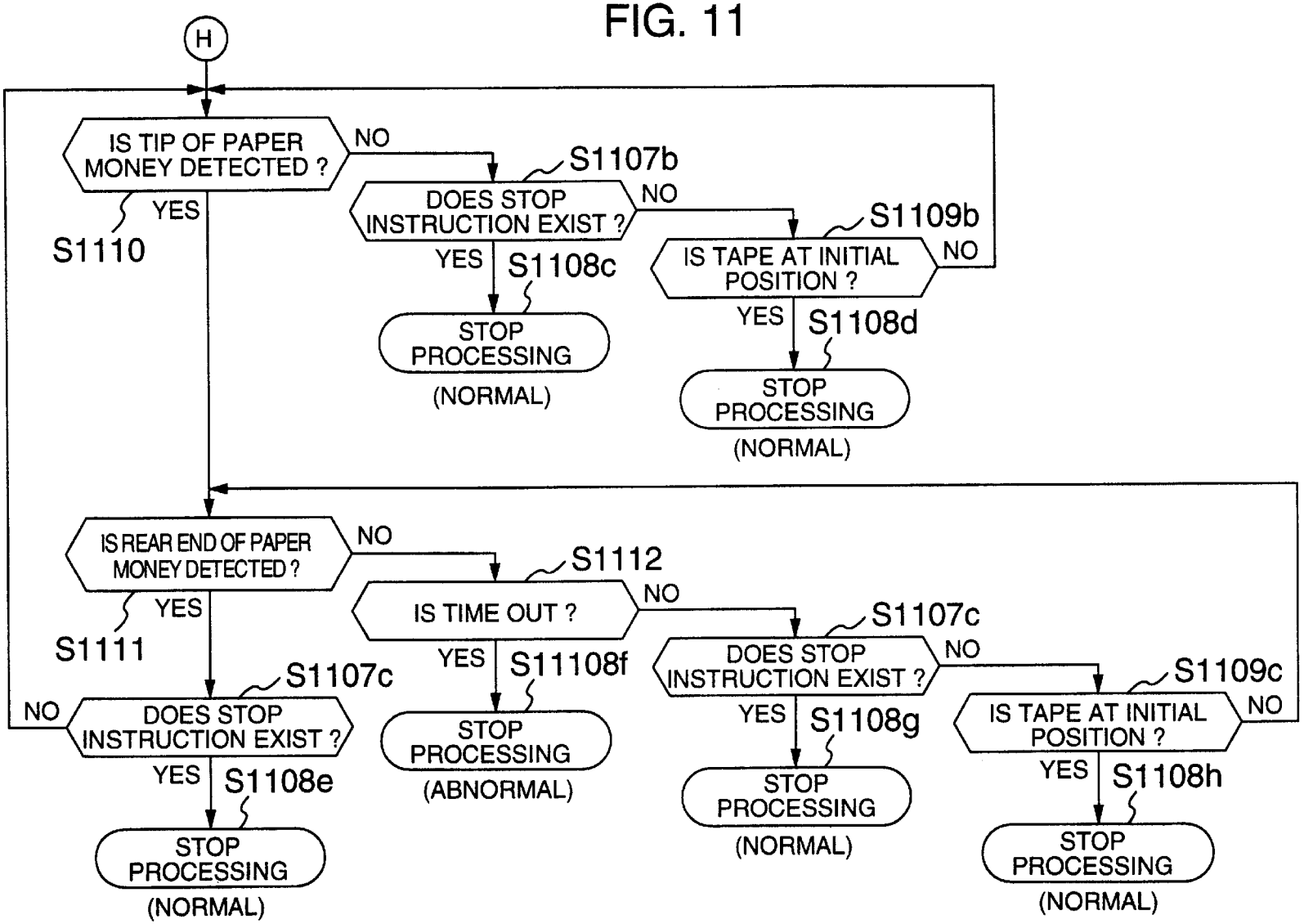
FIG. 11 is a flowchart useful for explaining a paper money delivery processing (No. 2)

(2) Explanation of Flow of Paper Money Delivery Processing:

FIGS. 10 and 11 are flowcharts of the paper money delivery operation.

When the paper money delivery operation is started as shown in FIGS. 10 and 11, the target speed set on the basis of the speed at the end of the speed control of the previous paper money receipt processing is set (Step S1101). The reel driving motor 107 and the wheel driving motor 111 are accelerated in the paper money delivery direction (Steps S1102 and S1103). When their speeds reach the target speeds set in Step S1101 (Step S1104: Yes), speed control of the wheel driving motor 111 and the reel driving motor 107 are conducted (Steps S1105 and S1106) until the stop instruction is given (Steps S1107*a*: Yes, S1107*a*: Yes, S1107*b*: Yes, S1107*c*: Yes, S1107*d*: Yes) or until the tape initial position sensor 121 detects the tape tip (Steps S1109*a*: Yes, S1109*b*: Yes, S1109*c*: Yes). Paper money is then delivered serially (Steps S1110, S1111).

Figure 12:
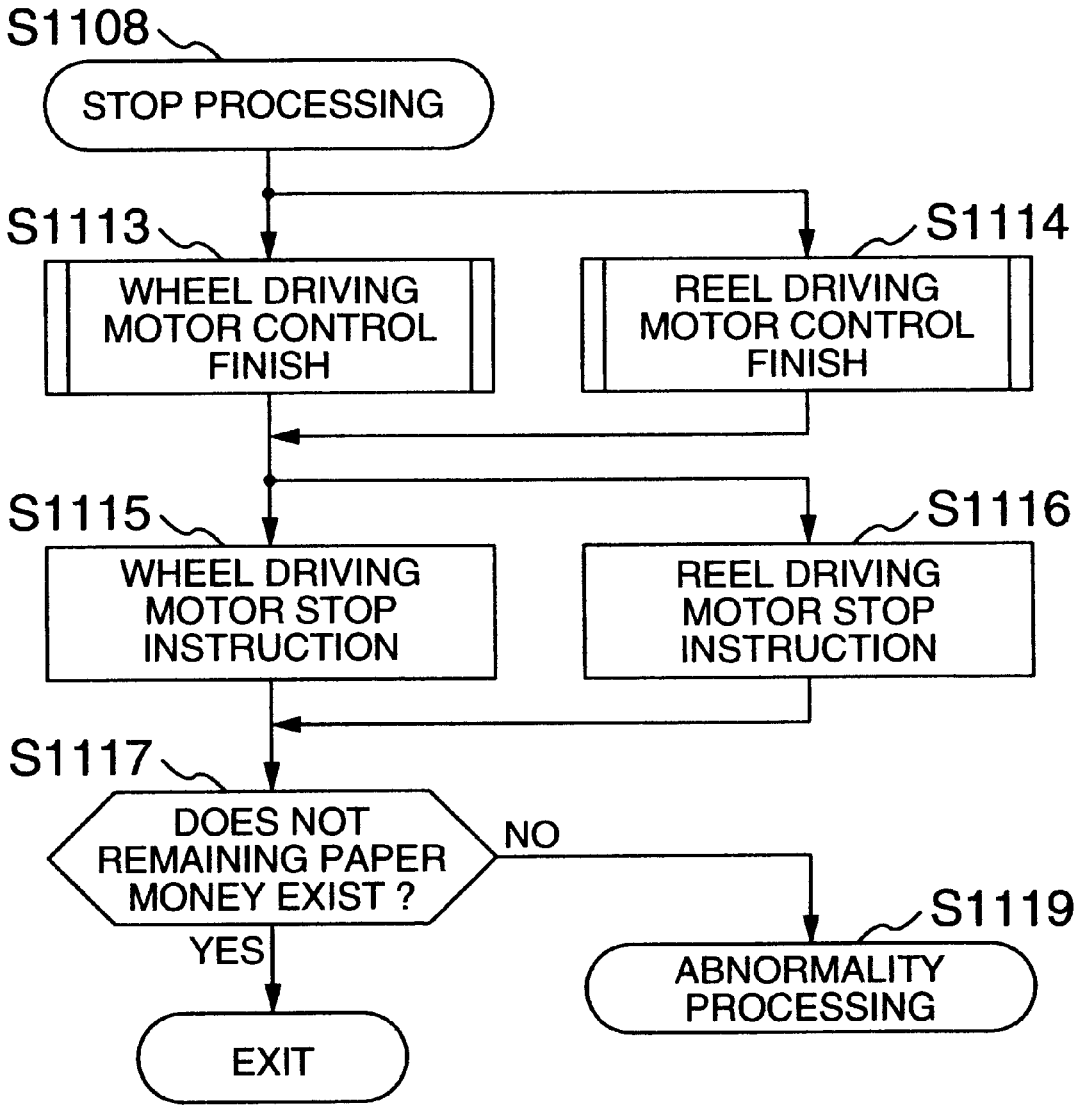
FIG. 12 is a flowchart useful for explaining a paper money delivery processing (No. 3)

FIG. 12 is a flowchart useful for explaining the stop processing.

As shown in the flowchart, when the stop instruction or the tape initial position is detected, speed control of the wheel driving motor 111 and the reel driving motor 107 is finished (Steps S1113 and S1114), and these motors are stopped (Steps S1115 and S1116). Unless the remaining paper money sensors 118 and 119 detect any remaining paper money (Step S1117: Yes), the paper money delivery processing is finished. If any remaining paper money is detected, an abnormality processing is executed (Step S1119).

(3) Explanation of Calculation Formulas for Calculating Outer Diameter of Reel 106 at Receipt Initial Stage (the Term "Diameter" Used Herein Means the Diameter Inclusive of the Tape Wound):

The outer diameter $d_1$ of the reel 106 at the finish of the delivery operation might exhibit certain variance depending on the winding condition of the tape T. Therefore, the outer diameter $d_2$ of the reel 106 at the start of the paper money receipt processing is measured. The outer diameter $d_2$ of the reel 106 is calculated from the count number $C_2$ of the encoder 115 fitted to the wheel driving motor 111 when the length of the tape T corresponding to the count number $C_1$ of the encoder 114 is taken up on the wheel 105.

Figure 4:
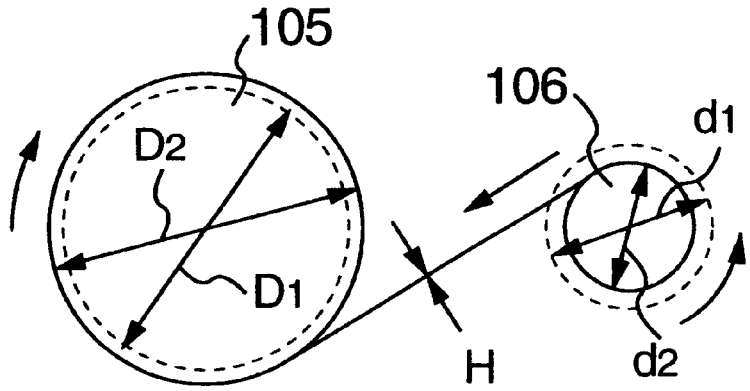
FIG. 4 is a conceptual view useful for explaining calculation of a reel outer diameter at an initial stage of receiving paper money.

Referring to FIG. 4, it will be assumed that the wheel 105 having a diameter $D_1$ and the reel 106 having a diameter $d_1$ respectively rotate N turns and n turns and their diameters respectively change to $D_2$ and $d_2$ after the tape T having a thickness H is transferred and wound onto the wheel 105. Then, $$D_2=D_1+2\cdot N\cdot H \tag{1}$$

$$d_1=d_2+2\cdot n\cdot H \tag{2}$$

The amount of the tape T wound on the wheel 105 and the amount of the tape T leaving the reel 106 are equal to each other. Therefore, $$(D_2/2)^2\cdot\pi-(D_1/2)^2\cdot\pi=(d_1/2)^2\cdot\pi-(d_2/2)^2\cdot\pi$$

This formula can be changed as follows:

$$D_2^2-D_1^2=d_1^2 d_2^2 \tag{3}$$

From the formulas (1), (2) and (3), $d_2$ is given by the following formula:

$$d_2=\{(N^2-n^2)\cdot H+N\cdot D_1\}/n \tag{4}$$

Here, it will be assumed that the count number of the encoder 115 fitted to the wheel driving motor 111 when the amount of the tape T corresponding to the $C_1$ count of the encoder 114 fitted to the reel 106 is $C_2$ the reduction ratio between the wheel 105 and the wheel driving motor 111 is $G_H$, the number of pulses from the encoder 114 per revolution of the reel 106 is $P_1$ and the number of pulses from the encoder 115 per revolution of the wheel driving motor 111 is $P_2$. Then, since $$n=C_1/P_1(\text{revolution})$$

and $$N=C_2/(P_2/G_H)\ (\text{revolution}),$$

these n and N are put into the formula (4), $$d_2=[\{(C_2/(P_2/G_H))^2-(C_1/P_1)^2\}\cdot H+C_2/(P_2/G_H)\cdot D_1]/(C_1/P_1)) \tag{5}$$

The formula (5) is the calculation formula for calculating the outer diameter $d_2$ of the reel 106 in the initial stage of the note receipt.

(4) Explanation of Control of Tape Traveling Speed

The following concrete example is hereby assumed by way of example.

It will be further assumed that the note receipt operation is conducted at the speed of the conveying path 10 of $V_2$=1,600 (mm/sec), the number of pulses $P_1$ from the encoder 114 per revolution of the reel 106 of $P_1$=6, the number of pulses $P_2$ of the encoder 115 per revolution of the wheel driving motor 111 of $P_2$=200, the diameter $D_o$ of the wheel 105 at the winding initial position of $D_o$=80 (mm), the thickness H of the tape T of H=0.041 (mm), the reduction ratio $G_w$ between the wheel 105 and the wheel driving motor 111 of $G_w$=⅔, the reduction ratio $G_R$ between the reel 106 and the reel driving motor 107 of $G_R$=2, and the count by number $C_1$ of the encoder 114 for calculating the initial outer diameter of the paper money receipt operation of the reel 106 of $C_1$=50.

At this time, the speed of the wheel driving motor 106 is controlled so that the set speed $V_1$ of the tape is higher by 3%, i.e. 1,648 (mm/sec), than the conveying speed $V_2$.

The rotating speed ω (revolution/sec) of the reel is given by the formula (6) below at the tape speed $V_1$ (mm/sec), the reel diameter d (mm) and the time t (msec) required for one round of the reel:

$$\omega=1/(t/1000)=1000/t \tag{6}$$

Since $V_1=d\cdot\pi\omega=d\cdot\pi\cdot1000/t$, the time t required for one round of the reel is given by the formula (7):

$$t=(1000\cdot\pi/V_1)\cdot d \tag{7}$$

Assuming that the initial diameter at the start of the reel revolution (immediately after (3) measurement of the reel initial diameter) is $d_2$ and the add-up value of the count number of the encoder 114 from the start of the reel revolution is $n_s$, the following formula (8) is acquired from the formula (2):

$$d=d_2-2(n_s/6)\cdot H=d_2-n_s\cdot H/3 \tag{8}$$

From the formulas (7) and (8), $$t=1000\cdot\pi/V_1\cdot(d_2-n_s\cdot H/3) \tag{9}$$

From the formula (9), the tape speed $V_1$ reaches 1,648 (mm/sec) at t given below:

$$\begin{aligned} t &= 1000\cdot\pi/1648\cdot(d_2-n_s\cdot 0.041/3) \\ &= 1.9063\cdot d_2-0.026053\cdot n_s \end{aligned}$$

Assuming $S_1=1.9063\cdot10{,}000\cdot d_2$, $S_1$ is given as follows from the formula (5):

$$\begin{aligned} S_1 &= 1.9063\cdot10000\cdot[\{(C_2/(P_2/G))^2-(C_1/P_1)^2\}\cdot H+ \\ &\quad C_2/(P_2/G)\cdot D_1]/(C_1/P_1) \\ &= 1.9063\cdot10000\cdot(0.547\cdot10^{-7}\cdot C_2^2+ \\ &\quad 0.032\cdot C_2-0.3417)\cong C_2^2/959+610\cdot C_2-6514 \end{aligned} \tag{10}$$

The formula (10) is rearranged as follows:

$$10000\cdot t=S_1-261\cdot n_s \tag{11}$$

In other words, when the wheel driving motor 111 is driven to rotate the reel 106 at a speed such that the required time t (msec) per revolution of the reel satisfies the formula (11), the tape speed $V_1$ can be set to the set value of 1,648 (mm/sec).

The set speed $V_1$ of the tape reaches 1,552 (mm/sec) lower by 3% than the conveying speed $V_2$ during the delivery of paper money when t satisfies the following formula (12):

$$\begin{aligned} t &= 1000\cdot\pi/(1552\cdot(d_2-n_s\cdot0.041/3) \\ &= 20.0242\cdot d_2-0.027664\cdot n_s \end{aligned} \tag{12}$$

Assuming hereby that $S_2=2.0242\cdot10000\cdot d_2$, the formula (5) gives:

$$\begin{aligned} S_1 &= 2.0242\cdot10000\cdot[\{C_2/(P_2/G)^2-(C_1/P_1)^2\}\cdot H+ \\ &\quad C_2/(P_2/G)\cdot D_1]/(C_1/P_1) \\ &= 2.0242\cdot10000\cdot(0.547\cdot10^{-7}\cdot C_2^2+ \\ &\quad 0.032\cdot C_2-0.3417)\cong C_2^2/903+648\cdot C_2-6917 \end{aligned} \tag{13}$$

Accordingly, the formula (13) is rearranged as follows:

$$10000\cdot t=S_2-277\cdot n_s \tag{14}$$

In other words, when the wheel driving motor 111 is driven to rotate the reel 106 at a speed such that the required time t (msec) per revolution of the reel satisfies the formula (11), the tape speed $V_1$ can be set to the set value of 1,552 (mm/sec).

Assuming in this case that no speed difference exists between the rotating speed $V_{RM}$ of the reel driving motor 107 and the reel rotating speed $V_R$, $$V_{Rm}=V_R=1/(G_R\cdot1000\cdot t)=1/2000\cdot t \tag{15}$$

However, in order to generate the difference of the rotating speeds between the reel 106 and the reel driving motor 107 and to prevent the occurrence of jamming by imparting the tension to the tape T in accordance with the set torque of the torque limiter 110 as described above, the speed difference must be provided between the rotating speed $V_{RM}$ of the reel driving motor 107 and the reel rotating speed $V_R$ so as to satisfy the relation $V_{RM}<1/2000t$ (revolution/sec) at the time of the receipt of paper money and the relation $V_{RM}>1/2000t$ (revolution/sec) at the time of the delivery of paper money.

When the speed difference is great at this time, reliability or service life of the torque limiter 110 is lowered. Therefore, a rotating speed difference of about 5% is given to secure reliability of the torque limiter 110 and to stabilize the tension of the tape T. In other words, the rotating speed $V_{RM}$ of the reel driving motor 107 at the time of the receipt of paper money is:

$$\begin{aligned} V_{RM} &= (1-0.05)/2000t \\ &= 4.75\times10^{-6}t \text{ (revolution/sec)} \end{aligned} \tag{16}$$

At the time of the delivery of paper money, on the other hand, $$\begin{aligned} V_{RM} &= (1+0.05)/2000t \\ &= 5.25\times10^{-6}t \text{ (revolution/sec)} \end{aligned} \tag{17}$$

As the rotating speed difference is provided between the reel 106 and the reel driving motor 107, it becomes possible to prevent the occurrence of jamming when paper money is delivered to the conveying path.

As explained above, the paper money handling device according to the present invention actuates the motor from the point of time at which the paper money passage sensor detects the passage of paper money at the time of receipt paper money and can set the winding speed a little higher than the paper money conveying speed of the conveying path. In consequence, the device can prevent the occurrence of jamming at the delivery portion with the conveying path and can smoothly deliver paper money. When paper money is delivered, the paper money handling device sets the delivering speed a little lower than the paper money conveying speed of the conveying path. Therefore, the device can prevent the occurrence of jamming and can smoothly deliver paper money. In addition, slacking of the tape can be prevented by the speed control by means of the torque limiter, and a stable tension can be imparted to the tape. Consequently, paper money can be stably taken up.

What is claimed is:

1. A paper money handling device including paper money conveying means for conveying paper money, a wheel connected to one of the ends of a tape, for winding paper money with said tape, a reel connected to the other end of said tape, for rewinding the tape wound on said wheel, wheel driving means for driving said wheel, and reel driving means for driving said reel, said wheel driving means and said reel driving means winding and rewinding said tape between said wheel and said reel when they are driven to thereby wind paper money conveyed from said paper money conveying means with said tape onto said wheel, or rewinding said tape wound on said wheel with paper money to said reel and delivering paper money to said paper money conveying means, said paper money handling device comprising:

first pulse detection means for detecting a pulse generated in such a fashion as to correspond to a rotating angle of said wheel;

second pulse detection means for detecting a pulse generated in such a fashion as to correspond to a rotating angle of said reel;

initial diameter calculation means for calculating an initial diameter of said reel on the basis of an add-up value of the number of pulses detected by said first pulse detection means and an add-up value of the number of pulses detected by said second pulse detection means when a predetermined amount of said tape is wound onto said wheel;

moving speed calculation means for calculating a moving speed of said tape by use of the initial diameter of said reel calculated by said initial diameter calculation means; and control means for controlling said wheel driving means and said reel driving means so that the moving speed calculated by said moving speed calculation means reaches a predetermined set speed.

2. A paper money handling device according to claim 1, wherein said means for calculating the moving speed of said tape is means for adding the number of pulses detected by said second pulse detection means when said tape is rotated from said reel in a tape delivering direction with the calculated initial diameter of said reel as a starting point, adding the number of pulses generated in response to the rotating angles of said reel in such a fashion as to subtract the number of pulses detected by said second pulse detection means when said reel is rotated in a rewinding direction, and calculating the moving speed of said tape from the delivery amount of said tape calculated from the number of pulses added and from the thickness of said tape, and from a present diameter of said reel calculated from the initial diameter of said reel.

3. A paper money handling device according to claim 2, wherein, when said reel is rotated in the delivering direction of said tape, said wheel driving means is controlled so that the calculated moving speed of said tape reaches a predetermined set speed and said reel driving means is controlled so that the reel driving speed becomes lower than said set speed; and wherein, when said reel is rotated in the rewinding direction of said tape, said wheel driving means is controlled so that the calculated moving speed of said tape reaches a predetermined set speed and said reel driving means is controlled so that the reel driving speed becomes higher than said set speed.

4. A paper money handling device according to claim 3, wherein said set speed is higher than the conveying speed of said paper money conveying means when said wheel rotates in the winding direction of said tape, and is lower than the conveying speed of said paper money conveying means when said wheel rotates in the delivering direction of said tape.

5. A paper money handling device according to claim 2, wherein said set speed is higher than the conveying speed of said paper money conveying means when said wheel rotates in the winding direction of said tape, and is lower than the conveying speed of said paper money conveying means when said wheel rotates in the delivering direction of said tape.

6. A paper money handling device according to claim 1, wherein, when said reel is rotated in the delivering direction of said tape, said wheel driving means is controlled so that the calculated moving speed of said tape reaches a predetermined set speed and said reel driving means is controlled so that the reel driving speed becomes lower than said set speed; and wherein, when said reel is rotated in the rewinding direction of said tape, said wheel driving means is controlled so that the calculated moving speed of said tape reaches a predetermined set speed and said reel driving means is controlled so that the reel driving speed becomes higher than said set speed.

7. A paper money handling device according to claim 6, wherein said set speed is higher than the conveying speed of said paper money conveying means when said wheel rotates in the winding direction of said tape, and is lower than the conveying speed of said paper money conveying means when said wheel rotates in the delivering direction of said tape.

8. A paper money handling device according to claim 1, wherein said set speed is higher than the conveying speed of said paper money conveying means when said wheel rotates in the winding direction of said tape, and is lower than the conveying speed of said paper money conveying means when said wheel rotates in the delivering direction of said tape.

9. A paper money handling device including paper money conveying means for conveying paper money, a wheel connected to one of the ends of a tape, for winding paper money with said tape, a reel connected to the other end of said tape, for rewinding the tape wound on said wheel, wheel driving means for driving said wheel, and reel driving means for driving said reel, said wheel driving means and said reel driving means winding and rewinding said tape between said wheel and said reel when they are driven to thereby wind paper money conveyed from said paper money conveying means with said tape onto said wheel, or rewinding said tape wound on said wheel with paper money to said reel and delivering paper money to said paper money conveying means, wherein said reel driving means is dedicated to the reel and is provided separately from said wheel driving means; and wherein said wheel driving means drives to rotate said wheel in a tape winding direction to wind said tape to said wheel, while said reel driving means drives to rotate said reel in a tape discharging direction.

10. A paper money handling device according to claim 9, wherein said reel driving means is driven in the delivering direction of said tape when winding said tape on said wheel.

11. A paper money handling device according to claim 10, wherein a torque limiter is provided between said reel and said reel driving means, and said reel driving means is driven so as not to exceed allowable number of revolution of said torque limiter.

12. A paper handling device according to claim 9, wherein:

said wheel and said wheel driving means are directly connected; and a torque limiter for limiting tension is provided between said reel and said reel driving means.

13. A paper handling device according to claim 12, wherein the torque limiter controls a speed of said reel driving means so that tension corresponding to a set torque of the torque limiter is applied to the tape.

* * * * *